US008663399B2

(12) United States Patent
Hasegawa et al.

(10) Patent No.: US 8,663,399 B2
(45) **Date of Patent: *Mar. 4, 2014**

(54) IRON-BASED HIGH SATURATION INDUCTION AMORPHOUS ALLOY

(75) Inventors: Ryusuke Hasegawa, Morristown, NJ (US); Daichi Azuma, Myrtle Beach, SC (US); Yoshihito Yoshizawa, Fukaya (JP); Yuichi Ogawa, Kumagaya (JP)

(73) Assignees: Metglas, Inc., Conway, SC (US); Hitachi Metals, Ltd., Tokyo (JP)

( * ) Notice: Subject to any disclaimer, the term of this patent is extended or adjusted under 35 U.S.C. 154(b) by 1001 days.

This patent is subject to a terminal disclaimer.

(21) Appl. No.: 11/320,744

(22) Filed: Dec. 30, 2005

(65) Prior Publication Data

US 2006/0191602 A1 Aug. 31, 2006

Related U.S. Application Data

(63) Continuation-in-part of application No. 11/059,567, filed on Feb. 17, 2005, now abandoned.

(51) Int. Cl.
*H01F 1/153* (2006.01)

(52) U.S. Cl.
USPC ..... 148/304; 148/403; 420/117; 420/121

(58) Field of Classification Search
USPC ..... 148/304
See application file for complete search history.

(56) References Cited

U.S. PATENT DOCUMENTS

| | | | | |
|---|---|---|---|---|
| 4,142,571 | A | 3/1979 | Narasimhan | |
| 4,217,135 | A | 8/1980 | Luborsky et al. | 148/304 |
| 4,219,355 | A | 8/1980 | DeCristofaro et al. | 148/304 |
| 4,226,619 | A | 10/1980 | Hatta et al. | |
| 4,249,969 | A | 2/1981 | DeCristofaro et al. | 148/108 |
| 4,298,409 | A | 11/1981 | DeCristofaro et al. | 148/108 |
| 4,300,950 | A | 11/1981 | Luborsky et al. | 148/304 |
| 4,437,907 | A | 3/1984 | Sato et al. | 148/304 |

(Continued)

FOREIGN PATENT DOCUMENTS

| | | |
|---|---|---|
| EP | 0 049 770 A2 | 4/1982 |
| EP | 0380557 B1 | 5/1994 |

(Continued)

OTHER PUBLICATIONS

Moskowitz, Bruce E., "Fundamental Physical Constants and Conversion Factors", Global Earth Physics, A Handbook of Physical Constants pp. 346 to 355, No Publication date avaliable, downloaded from www.agu.org/reference/gephys/23_moskowitz.pdf.*

(Continued)

*Primary Examiner* — Roy King
*Assistant Examiner* — Xiaowei Su

(57) ABSTRACT

An iron-based amorphous alloy and magnetic core with an iron-based amorphous alloy having a chemical composition with a formula $Fe_aB_bSi_cC_d$, where $81<a\leq84$, $10\leq b\leq18$, $0<c\leq5$ and $0<d<1.5$, numbers being in atomic percent, with incidental impurities, simultaneously have a value of a saturation magnetic induction exceeding 1.6 tesla, a Curie temperature of at least 300° C. and a crystallization temperature of at least 400° C. When cast in a ribbon form, such an amorphous metal alloy is ductile and thermally stable, and is suitable for various electric devices because of high magnetic stability at such devices' operating temperatures.

19 Claims, 4 Drawing Sheets

(56) References Cited

U.S. PATENT DOCUMENTS

| | | | | |
|---|---|---|---|---|
| 4,763,030 | A | 8/1988 | Clark et al. | |
| 4,865,664 | A | 9/1989 | Sato et al. | 148/403 |
| 4,889,568 | A | 12/1989 | Datta et al. | 148/108 |
| 5,593,513 | A | 1/1997 | Ramanan et al. | |
| 5,593,518 | A | 1/1997 | Ramanan | 148/304 |
| 6,420,042 | B1 | 7/2002 | Sakamoto et al. | |

FOREIGN PATENT DOCUMENTS

| | | | |
|---|---|---|---|
| EP | 1 615 241 | A2 | 1/2006 |
| JP | 59-150415 | | 8/1984 |
| JP | 64-36726 | | 2/1989 |
| JP | 2-38519 | | 2/1990 |
| JP | 5-140703 | | 6/1993 |
| JP | 9 129430 | A | 5/1997 |
| JP | 9-202946 | A | 8/1997 |
| JP | 10-280034 | A | 10/1998 |
| JP | 2006-45662 | | 2/2006 |
| TW | 341601 | | 1/1983 |

OTHER PUBLICATIONS

U.S. Appl. No. 11/059,567, filed Feb. 17, 2005, R. Hasegawa, Metglas, Inc.
PCT Notification of Transmittal of the International Search Report and the Written Opinion of the International Searching Authority, or the Declaration dated Jul. 31, 2006, Form PCT ISA 220, (2 pgs) (in English).
PCT International Search Report dated Jul. 31, 2006, Form PCT ISA 210, (3 pgs) (in English).
PCT Written Opinion of the International Search Authority dated Jul. 31, 2006, From PCT ISA 237, (5 pgs) (in English).
PCT Notification of Transmittal of International Preliminary Examination Report dated Dec. 26, 2006, Form PCT/IPEA/416, 1 page (in English).
PCT International Preliminary Examination Report dated Nov. 28, 2006, Form PCT/IPEA/409, 3 pages (in English).
P.R. China First Office Action, issued Oct. 17, 2008 (8 pgs.) (in English).
Chinese Office Action issued Jun. 5, 2009 in corresponding Chinese Patent Application 200680011190.0.
Japanese Office Action issued Apr. 21, 2011 in corresponding Japanese Patent Application 2007-556329.
English Translation of a Chinese Office Action issued Aug. 13, 2010 in corresponding Chinese Patent Application 200680011190.0.
U.S. Office Action mailed Sep. 14, 2010 in related U.S. Appl. No. 12/654,763.
U.S. Office Action mailed Mar. 11, 2011 in related U.S. Appl. No. 12/654,763.
U.S. Notice of Allowance issued Sep. 27, 2012 in co-pending U.S. Appl. No. 12/654,763.
Office Action mailed Feb. 10, 2012 in co-pending U.S. Appl. No. 12/654,763.
Office Action issued in co-pending U.S. Appl. No. 12/654,763 mailed, Dec. 1, 2011.
Office Action issued in co-pending U.S. Appl. No. 12/654,763 mailed Sep. 6, 2011.
Korean Office Action issued Oct. 22, 2012 in corresponding Korean Patent Application No. 10-2007-7019653.
David Jiles, "Introduction to Magnetism and Magnetic Materials", Chapman and Hall, pp. 152-154 (in English).
Ryusuke Hasegawa, Ph.D., "Glassy Metals: Magnetic, Chemical, and Structural Properties", CRC Press, Inc., p. 169 (in English).
U.S. Appl. No. 11/059,567, filed Feb. 17, 2005, R. Hasegawa, et al. Metglas, Inc. and Hitachi Metals, Ltd.
U.S. Appl. No. 12/654,763, filed Dec. 31, 2009, R. Hasegawa, et al, Metglas, Inc. and Hitachi Metals, Ltd.
http://www.omega.com/guides/thermocouples.html, Selection Guide: Thermocouple, pp. 1-3 (in English).
Notice of Abandonment mailed Mar. 25, 2008 in U.S. Appl. No. 11/059,567.
Non-Final Office Action mailed on Sep. 13, 2007 in U.S. Appl. No. 11/059,567.
Advisory Action mailed Jun. 27, 2007 in U.S. Appl. No. 11/059,567.
Final Office Action mailed Mar. 12, 2007 in U.S. Appl. No. 11/059,567.
Non-Final Office Action mailed Sep. 27, 2006 in U.S. Appl. No. 11/059,567.
Advisory Action mailed Jul. 10, 2006 in U.S. Appl. No. 11/059,567.
Final Office Action mailed Mar. 22, 2006 in U.S. Appl. No. 11/059,567.
Non-Final Office Action mailed Sep. 29, 2005 in U.S. Appl. No. 11/059,567.
European Search Report issued on May 13, 2011 in corresponding European Patent Application No. 06 735 368.0-1215.
European Office Action mailed Mar. 4, 2013 for corresponding European Application No. 06735368.0.
Taiwanese Office Action mailed Mar. 21, 2013 for corresponding Taiwanese Application No. 095103342.
Korean Office Action mailed Apr. 13, 2013 for corresponding Korean Application No. 10-2007-7019653.
F. E. Luborsky, PhD, "Amorphous Metallic Alloys", Butterworths, 1983, 7 pgs.
D. Raskin and C. H. Smith, "Applications of amorphous metals; progress and prospects", chapter 20, pp. 381, and 397-400.
C. Modzelewski, et al., "Magnetomechanical Coupling and Permeability in Transversely Annealed Metglas 2605 Alloys", IEEE Transactions on Magnetics, vol. Mag-17, No. 6, Nov. 1981, pp. 2837-2839.
Ryusuke Hasegawa, Ph.D., "Glassy Metals: Magnetic, Chemical, and Structural Properties", CRC Press, Inc. 1983, pp. 183-189.

* cited by examiner

IRON-BASED HIGH SATURATION INDUCTION AMORPHOUS ALLOY

RELATED U.S. APPLICATION DATA

Continuation-in-part of application Ser. No. 11/059,567, filed on Feb. 17, 2005, now abandoned.

CROSS-REFERENCE TO RELATED APPLICATIONS

This application is a continuation-in-part Application of, and claims priority benefit under 35 U.S.C. §120 to, U.S. application Ser. No. 11/059,567 filed Feb. 17, 2005, now abandoned, the disclosure of which is incorporated herein by reference.

BACKGROUND OF THE INVENTION

1. Field of the Invention

This invention relates to an iron-based amorphous alloy with a saturation induction exceeding 1.6 Tesla and adapted for use in magnetic devices, including transformers, motors and generators, pulse generators and compressors, magnetic switches, magnetic inductors for chokes and energy storage and sensors.

2. Description of the Related Art

Iron-based amorphous alloys have been utilized in electrical utility transformers, industrial transformers, in pulse generators and compressors based on magnetic switches and electrical chokes. In electrical utility and industrial transformers, iron-based amorphous alloys exhibit no-load or core loss which is about ¼ that of a conventional silicon-steel widely used for the same applications operated at an AC frequency of 50/60 Hz. Since these transformers are in operation 24 hours a day, the total transformer loss worldwide may be reduced considerably by using these magnetic devices. The reduced loss means less energy generation, which in turn translates into reduced $CO_2$ emission.

For example, according to a recent study conducted by International Energy Agency in Paris, France, an estimate for energy savings in the Organization for Economic Co-operation and Development (OECD) countries alone that would occur by replacing all existing silicon-steel based units was about 150 TWh in year 2000, which corresponds to about 75 million ton/year of $CO_2$ gas reduction. The transformer core materials based on the existing iron-rich amorphous alloys have saturation inductions B, less than 1.6 Tesla. The saturation induction $B_5$ is defined as the magnetic induction B at its magnetic saturation when a magnetic material is under excitation with an applied field H. Compared with $B_s$~2 Tesla for a conventional grain-oriented silicon-steel, the lower saturation inductions of the amorphous alloys leads to an increased transformer core size. It is thus desired that the saturation induction levels of iron-based amorphous alloys be increased to levels higher than the current levels of 1.56-1.6 Tesla.

In motors and generators, a significant amount of magnetic flux or induction is lost in the air gap between rotors and stators. It is thus desirable to use a magnetic material with a saturation induction or flux density as high as possible. A higher saturation induction or flux density in these devices means a smaller size device, which is preferable.

Magnetic switches utilized in pulse generation and compression require magnetic materials with high saturation inductions, high BH squareness ratios defined as the ratios of the magnetic induction B at H=0 and $B_s$, low magnetic loss under AC excitation and small coercivity $H_c$ which is defined as the field at which the magnetic induction B becomes zero, and low magnetic loss under high pulse rate excitation. Although commercially available iron-based amorphous alloys have been used for these types of applications, namely in cores of magnetic switches for particle accelerators, $B_s$ values higher than 1.56-1.6 Tesla are desirable to achieve higher particle acceleration voltages which are directly proportional to $B_s$ values. A lower coercivity $H_c$ and a higher BH squareness ratio mean a lower required input energy for the magnetic switch operation. Furthermore a lower magnetic loss under AC excitation increases the overall efficiency of a pulse generation and compression circuit. Thus, clearly needed is an iron-based amorphous alloy with a saturation induction higher than $B_s$=1.6 Tesla, with $H_c$ as small as possible and the squareness ratio $B(H=0)/B_s$ as high as possible, exhibiting low AC magnetic loss. The magnetic requirements for pulse generation and compression and actual comparison among candidate magnetic materials was summarized by A. W. Melvin and A. Flattens in Physical Review Special Topics-Accelerators and Beams, Volume 5, 080401 (2002).

In a magnetic inductor used as an electrical choke and for temporary energy storage, a higher saturation induction of the core material means an increased current-carrying capability or a reduced device size for a given current-carrying limit. When these devices are operated at a high frequency, core material must exhibit low core losses. Thus, a magnetic material with a high saturation induction and a low core loss under AC excitation is preferable in these applications.

In sensor applications of a magnetic material, a high saturation induction means a high level of sensing signal, which is required for a high sensitivity in a small sensing device. Low AC magnetic losses are also necessary if a sensor device is operated at high frequencies. A magnetic material with a high saturation induction and a low AC magnetic loss is clearly needed in sensor applications.

In all of the above applications which are just a few representatives of magnetic applications of a material, a high saturation induction material with a low AC magnetic loss is needed. It is thus an aspect of this invention to provide such materials based on iron-based amorphous alloys which exhibit saturation magnetic induction levels exceeding 1.6 T and which are close to the upper limit of the commercially available amorphous iron-based alloys.

Attempts were made in the past to achieve an iron-based amorphous alloy with a saturation induction higher than 1.6 T. One such example is a commercially available METGLAS®2605CO alloy with a saturation induction of 1.8 T. This alloy contains 17 at. % Co and therefore too expensive to be utilized in commercial magnetic products such as transformers and motors. Other examples include amorphous Fe—B—C alloys as taught in U.S. Pat. No. 4,226,619. These alloys were found mechanically too brittle to be practically utilized. Amorphous Fe—B—Si-M alloys where M=C as taught in U.S. Pat. No. 4,437,907 were intended to achieve high saturation inductions, but were found to exhibit $B_s$<1.6 T.

Thus, there is a need for ductile iron-based amorphous alloys with saturation induction exceeding 1.6 T, having low AC magnetic losses and high magnetic stability at devices' operating temperatures.

SUMMARY OF THE INVENTION

In accordance with aspects of the invention, an amorphous metal alloy has a composition having a formula $Fe_aB_bSi_cC_d$ where $81<a\leq84$, $10\leq b\leq18$, $0<c\leq5$ and $0<d<1.5$, numbers being in atomic percent, with incidental impurities. When cast in a ribbon form, such an amorphous metal alloy is ductile and thermally stable, and has a saturation induction greater than 1.6 T and low AC magnetic loss. In addition, such an amorphous metal alloy is suitable for use in electric transformers, pulse generation and compression, electrical chokes, energy-storing inductors and magnetic sensors.

According to a first aspect of the present invention, an iron-based amorphous alloy is provided wherein the alloy has a chemical composition with a formula $Fe_aB_bSi_cC_d$ where $81<a\leq84$, $10\leq b\leq18$, $0<c\leq5$ and $0<d<1.5$, numbers being in atomic percent, with incidental impurities, and simultaneously has a value of saturation magnetic induction greater than 1.6 tesla, a Curie temperature of at least 300° C. and a crystallization temperature of at least 400° C.

According to a second aspect of the present invention, the alloy is represented by a formula of $Fe_{81.7}B_{16.0}Si_{2.0}C_{0.3}$, $Fe_{82.0}B_{16.0}Si_{1.0}C_{1.0}$, $Fe_{82.0}B_{14.0}Si_{3.0}C_{1.0}$, $Fe_{82.0}B_{13.5}Si_{4.0}C_{0.5}$, $Fe_{82.0}B_{13.0}Si_{4.0}C_{1.0}$, $Fe_{82.6}B_{15.5}Si_{1.6}C_{0.3}$, $Fe_{83.0}B_{13.0}Si_{3.0}C_{1.0}$ or $Fe_{84.0}B_{13.0}Si_{2.0}C_{1.0}$.

According to a third aspect of the present invention, the saturation magnetic induction of the alloy is greater than 1.65 tesla.

According to a fourth aspect of the present invention, the alloy is represented by a formula of $Fe_{81.7}B_{16.0}Si_{2.0}C_{0.3}$, $Fe_{82.0}B_{16.0}Si_{1.0}C_{1.0}$, $Fe_{82.0}B_{14.0}Si_{3.0}C_{1.0}$, $Fe_{82.0}B_{13.5}Si_{4.0}C_{0.5}$, or $Fe_{83.0}B_{13.0}Si_{3.0}C_{1.0}$.

According to a fifth aspect of the present invention, the alloy is heat-treated by annealing at temperatures between 300° C. and 350° C.

According to a sixth aspect of the present invention, the alloy is utilized in a magnetic core and has a core loss less than or equal to 0.5 W/kg after the alloy has been annealed, when measured at 60 Hz, 1.5 tesla and at room temperature.

According to a seventh aspect of the present invention, a DC squareness ratio of the alloy is greater than 0.8 after the alloy has been annealed.

According to an eighth aspect of the present invention, a magnetic core that includes a heat-treated iron-based amorphous alloy is provided, wherein the alloy is represented by a chemical composition with a formula $Fe_aB_bSi_cC_d$ where $81<a\leq84$, $10\leq b\leq18$, $0<c\leq5$ and $0<d<1.5$, numbers being in atomic percent, with incidental impurities, and simultaneously has a value of saturation magnetic induction greater than 1.6 tesla, a Curie temperature of at least 300° C. and a crystallization temperature of at least 400° C., wherein the alloy has been annealed at temperatures between 300° C. and 350° C., wherein a core loss is less than or equal to 0.5 W/kg after the alloy has been annealed, when measured at 60 Hz, 1.5 tesla and at room temperature, and wherein the magnetic core is a magnetic core of a transformer or a electrical choke coil.

According to a ninth aspect of the present invention, a magnetic core that includes a heat-treated iron-based amorphous alloy is provided, wherein the alloy is represented by a chemical composition with a formula $Fe_aB_bSi_cC_d$ where $81<a\leq84$, $10\leq b\leq18$, $0<c\leq5$ and $0<d<1.5$, numbers being in atomic percent, with incidental impurities, and simultaneously has a value of saturation magnetic induction greater than 1.6 tesla, a Curie temperature of at least 300° C. and a crystallization temperature of at least 400° C., wherein the alloy has been annealed at temperatures between 300° C. and 350° C., wherein a DC squareness ratio is greater than 0.8 after the alloy has been annealed, and wherein the magnetic core is an inductor core of a magnetic switch in a pulse generator and/or compressor.

Additional aspects and/or advantages of the invention will be set forth in part in the description which follows and, in part, will be obvious from the description, or may be learned by practice of the invention.

BRIEF DESCRIPTION OF THE DRAWINGS

Various aspects and advantages of the invention will become apparent and more readily appreciated from the following description of the embodiments, taken in conjunction with the accompanying drawings of which.

DETAILED DESCRIPTION OF PREFERRED EMBODIMENTS

Figure 1:
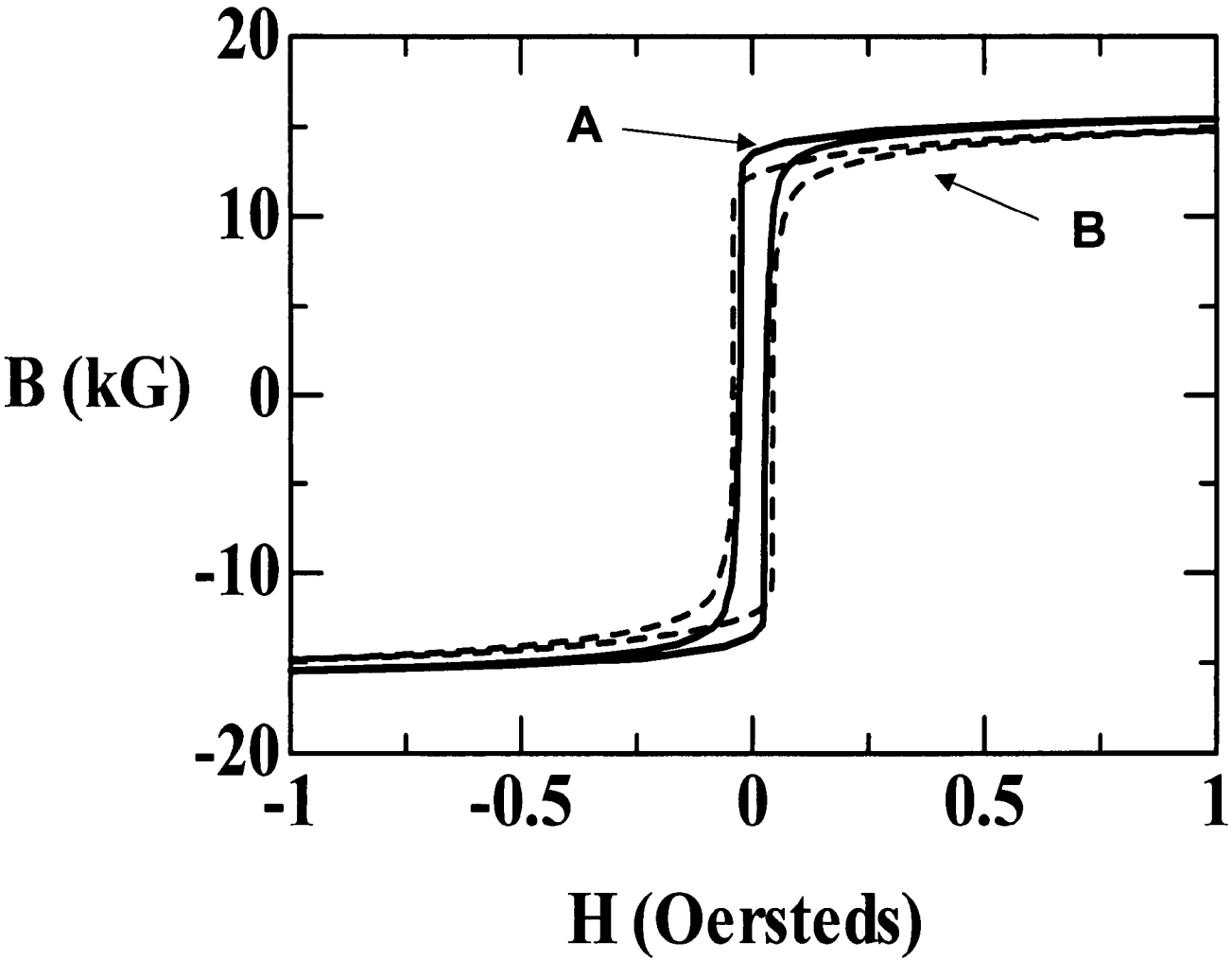
FIG. 1 illustrates a graphical representation with respect to coordinates of magnetic induction B and applied field H of up to 1 Oe, that compares the BH behaviors of an amorphous alloy annealed at 320° C. for one hour in a DC magnetic field of 20 Oe (1600 A/m) having a composition of $Fe_{81.7}B_{16.0}Si_{2.0}C_{0.3}$ of embodiments of the present invention, shown by curve A, with that of a commercially available iron-based amorphous METGLAS®2605SA1 alloy, shown by curve B, annealed at 360° C. for 2 hours in a DC magnetic field of 30 Oe (2400 A/m)

Reference will now be made in detail to the embodiments of the present invention, examples of which are illustrated in the accompanying drawings, wherein like reference numerals refer to the like elements throughout. The embodiments are described below to explain the present invention by referring to the figures.

An amorphous alloy, in accordance with embodiments of the present invention, is characterized by a combination of high saturation induction B, exceeding 1.6 T, low AC core loss and high thermal stability. The amorphous alloy has a chemical composition having a formula $Fe_aB_bSi_cC_d$ where $81<a\leq84$, $10\leq b\leq18$, $0<c\leq5$ and $0<d<1.5$, numbers being in atomic percent, with incidental impurities.

Iron provides high saturation magnetic induction in a material below the material's Curie temperature at which magnetic induction becomes zero. Accordingly, an amorphous alloy with a high iron content with a high saturation induction is desired. However, in an iron-rich amorphous alloy system, a material's Curie temperature decreases with the iron content. Thus, at room temperature a high concentration of iron in an amorphous alloy does not always result in a high saturation induction $B_s$. Thus, a chemical compositional optimization is necessary, as is set forth in accordance with embodiments of the present invention as described herein.

An alloy, in accordance with embodiments of the present invention, was readily cast into an amorphous state by using a rapid solidification method described in U.S. Pat. No. 4,142,571, the contents of which are incorporated herein by reference. The as-cast alloy is in a ribbon form and ductile. Typical examples of the magnetic and thermal properties of the amorphous alloys, in accordance with embodiments of the present invention, are given in Table I below:

TABLE I

Saturation Induction, Curie and Crystallization Temperature of the Amorphous Alloys For Embodiments of the Present Invention

| Composition (at. %) | Saturation Induction (T) | Curie Temperature (° C.) | Crystallization Temperature (° C.) |
|---|---|---|---|
| $Fe_{81.7}B_{16.0}Si_{2.0}C_{0.3}$ | 1.65 | 359 | 466 |
| $Fe_{82.0}B_{16.0}Si_{1.0}C_{1.0}$ | 1.66 | 353 | 451 |
| $Fe_{82.0}B_{14.0}Si_{3.0}C_{1.0}$ | 1.66 | 356 | 448 |
| $Fe_{82.0}B_{13.5}Si_{4.0}C_{0.5}$ | 1.65 | 359 | 453 |
| $Fe_{82.0}B_{13.0}Si_{4.0}C_{1.0}$ | 1.64 | 358 | 450 |
| $Fe_{82.6}B_{15.5}Si_{1.6}C_{0.3}$ | 1.64 | 348 | 444 |
| $Fe_{83.0}B_{13.0}Si_{3.0}C_{1.0}$ | 1.65 | 336 | 426 |
| $Fe_{84.0}B_{13.0}Si_{2.0}C_{1.0}$ | 1.63 | 315 | 401 |

All of these alloys have saturation inductions Bs exceeding 1.6 T. Curie temperatures exceeding 300° C. and crystallization temperatures exceeding 400° C. Since most of the magnetic devices commonly used are operated below 150° C., at which electrically insulating materials used in these devices burn or deteriorate rapidly, the amorphous alloys in accordance with embodiments of the present invention are thermally stable at the operating temperatures.

Comparison of the BH behaviors of the amorphous alloys in accordance with embodiments of the present invention and that of a commercially available iron-based amorphous alloy shows unexpected results. As clearly seen in FIG. 1 in which the BH loops are compared, the magnetization toward saturation is much sharper in the amorphous alloy in embodiments of the present invention than that in a commercially available amorphous iron-based alloy. The consequence of this difference is a reduced magnetic field needed to achieve a predetermined induction level in the alloys of embodiments of the present invention than the commercially available alloy as shown in FIG. 2.

Figure 2:
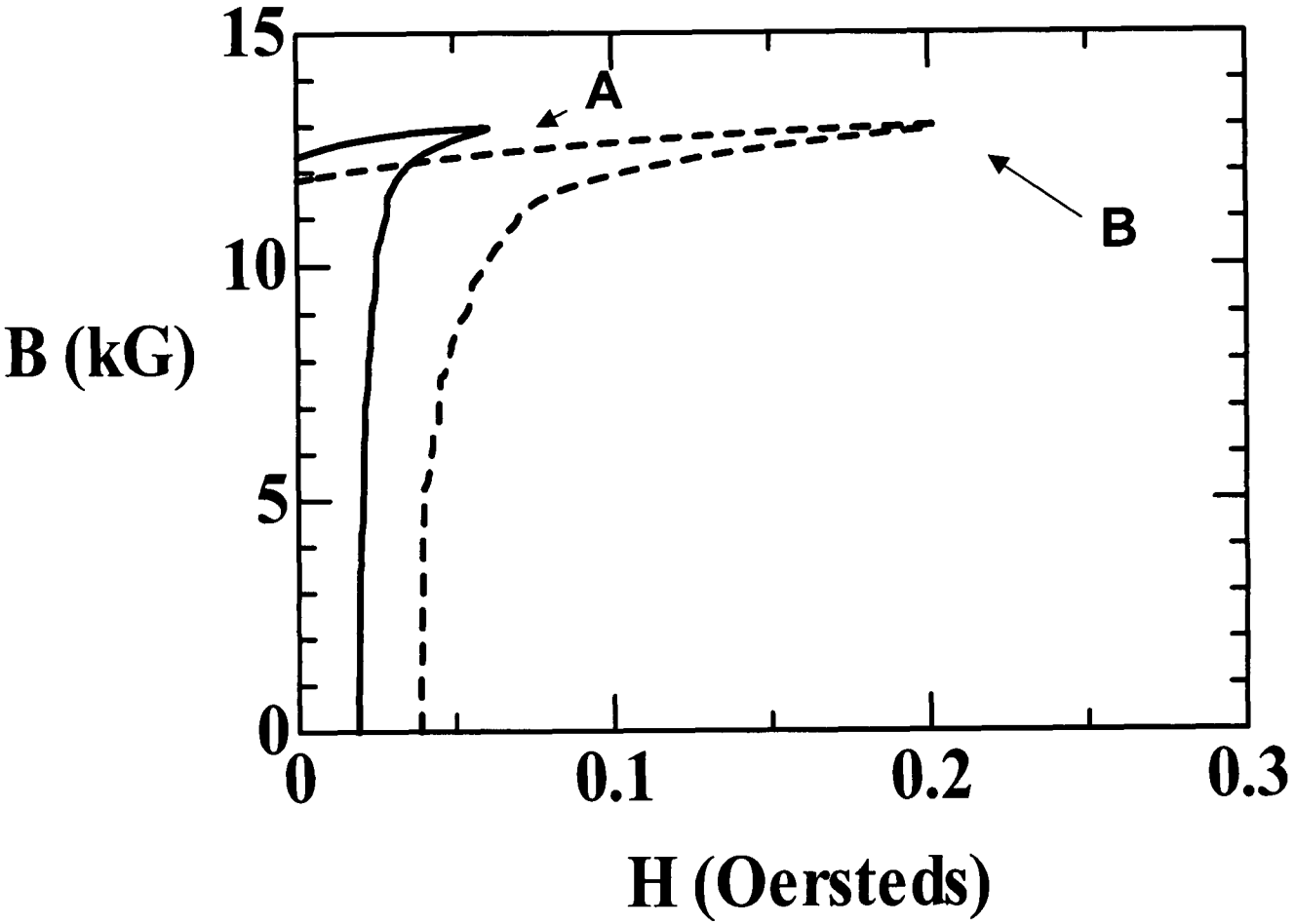
FIG. 2 illustrates a graphical representation with respect to coordinates of magnetic induction B and applied field H, that depicts the first quadrant of the BH curves of FIG. 1 up to the induction level of 1.3 Tesla with curve A and B, each referring to the same in FIG. 1.
Figure 3:
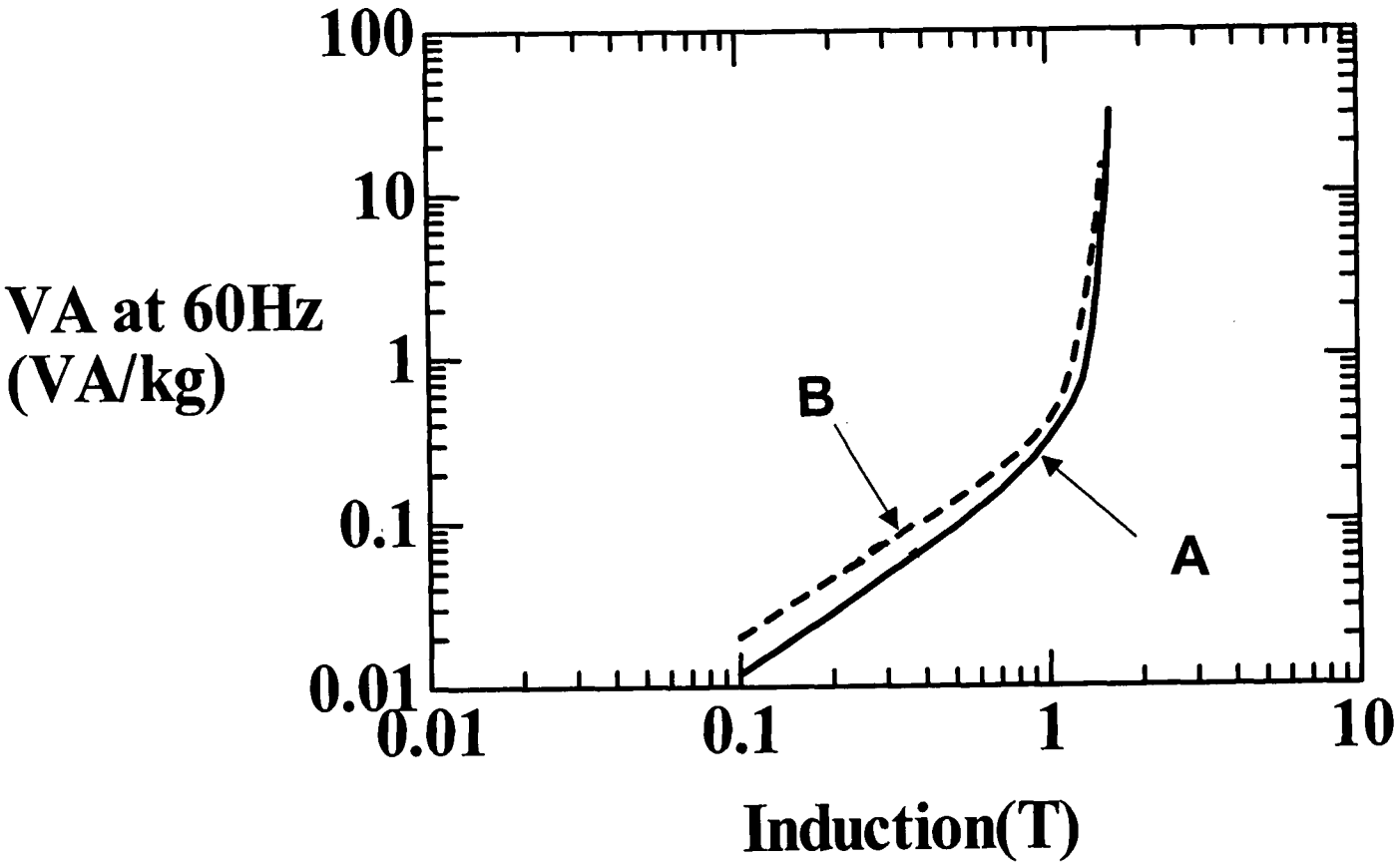
FIG. 3 illustrates a graphical representation with respect to coordinates of exciting power VA at 60 Hz and induction level B, that compares the exciting power of an amorphous alloy annealed at 320° C. for one hour in a DC magnetic field of 20 Oe (1600 A/m) having a composition of $Fe_{81.7}B_{16.0}Si_{2.0}C_{0.3}$ of embodiments of the present invention, shown by curve A, with that of a commercially available iron-based amorphous alloy METGLAS®2605SA1, shown by curve B, annealed at 360° C. for two hours in a DC magnetic field of 30 Oe (2400 A/m).

In FIG. 2, the excitation level was set at 1.3 Tesla, and the fields needed to achieve this excitation level were determined for an amorphous alloy in accordance with embodiments of the present invention and for a prior art amorphous alloy, METGLAS®2605SA1. It is clearly demonstrated that the amorphous alloy for embodiments of the present invention requires much less field, and hence less exciting current to achieve a same magnetic induction compared with the commercially available alloy. This is shown in FIG. 3 where exciting power, which is a product of the exciting current of the primary winding of a transformer and the voltage at the secondary winding of the same transformer, is compared among the two amorphous alloys of FIGS. 1 and 2. It is clear that exciting power for the amorphous alloy in accordance with embodiments of the present invention is lower at any excitation level than that of a commercially available METGLAS®2605SA1 alloy. Lower exciting power in turn results in a lower core loss for the alloys in accordance with embodiments of the present invention than for the commercially available amorphous alloy, especially at high magnetic excitation levels. Typical examples of core loss at high excitation are given in Table II for an amorphous alloy of embodiments of the present invention showing Bs=1.65 T in Table I and a commercially available amorphous alloy, METGLAS®2605SA1.

TABLE II

Core loss comparison at different induction levels between B = 1.3 and 1.5 T between a high saturation induction alloy for embodiments of the present invention and a commercially available amorphous iron-based alloy METGLAS ® 2605SA1. The measurements in accordance with the ASTM Standards listed in Example III were performed on the toroidal cores prepared following Example II and heat-treated at 320° C. for one hour in a DC field of 20 Oe (1600 A/m) for the amorphous alloy of embodiments of the present invention and at 360° C. for two hours in a DC field of 30 Oe (1600 A/m) for the commercially available alloy.

| Alloy | Core Loss at 60 Hz (W/kg) | | | |
|---|---|---|---|---|
| | B = 1.3 T | B = 1.4 T | B = 1.45 T | B = 1.5 T |
| $Fe_{81.7}B_{16.0}Si_{2.0}C_{0.3}$ | 0.24 | 0.29 | 0.33 | 0.38 |
| METGLAS ® 2605SA1 | 0.27 | 0.32 | 0.35 | n/a |

n/a: cores could not be excited at this level.

As expected and seen in Table II, core loss of a commercial amorphous alloy METGLAS®2605SA1 increases rapidly above 1.45 T induction because this alloy has a saturation induction $B_s$=1.56 T and cannot be excited above about 1.5 Tesla. Thus, no data point for B=1.5 T is given in Table II for METGLAS®2605SA1 alloy. The amorphous alloy in accordance with embodiments of the present invention, on the other hand, shows lower core loss than that of the commercially available alloy and can be excited beyond 1.45 T as indicated in Table II because this alloy has a saturation induction of 1.65 T, which is higher than the saturation induction of 1.56 T of the commercial amorphous alloy.

The unexpected sharpness of the BH behavior shown in FIG. 1 and FIG. 2 for the amorphous alloy for embodiments of the present invention is suited for its use as inductors in magnetic switches for pulse generation and compression. It is clear that an amorphous alloy in accordance with embodiments of the present invention has a higher saturation induction $B_s$, a lower coercivity and a higher BH squareness ratio than the commercial alloy. The higher level of $B_s$ of the alloy in accordance with embodiments of the present invention is especially suited to achieve a larger flux swing which is given by $2B_s$. Values of DC coercivity, a DC BH squareness ratio and $2B_s$ are compared in Table III.

TABLE III

Data taken by a BH loop tracer of Example III on toroidal cores made from an amorphous alloy of embodiments of the present invention and the commercially available METGLAS ® 2605SA1 alloy following the procedure described in Example II.

| Alloy | Coercivity (Oe) | Squareness Ratio (Br/Bs) | $2B_s$ (Tesla) |
|---|---|---|---|
| $Fe_{81.7}B_{16.0}Si_{2.0}C_{0.3}$ | 0.030 | 0.85 | 3.30 |
| METGLAS ® 2605SA1 | 0.043 | 0.78 | 3.12 |

From Table III, it is clear that the amorphous alloy in accordance with embodiments of the present invention is more suited for use as core materials for pulse generation and compression than a commercially available amorphous alloy.

The alloys of embodiments of the present invention were found to have a high thermal stability as indicated by the high crystallization temperatures of Table I. A supporting evidence for the thermal stability was obtained through accelerated aging tests in which core loss and exciting power at elevated temperatures above 250° C. were monitored over several months until these values started to increase. The time period at which the property increase was recorded at each aging temperature was plotted as a function of $1/T_a$, where $T_a$ was the aging temperature on the absolute temperature scale. The plotted data are best described by the following formula:

$$\text{tau} \propto \exp(-E_a/k_B T),$$

where tau is the time for an aging process to complete at temperature T. $E_a$ is the activation energy for the aging process, and $k_B$ is the Boltzmann constant. The data plotted on a logarithmic scale were extrapolated to the temperatures pertinent to the operating temperatures of widely used magnetic devices, such as transformers. This kind of plotting is known as an Arrhenius plot and is widely known in the industry to predict long-term thermal behavior of a material. An operating temperature of 150° C. was selected because most of the electrical insulating materials used in these magnetic devices either burn or deteriorate rapidly above about 150° C. Table IV is the result of the study, which indicates that an amorphous alloy according to embodiments of the present invention are thermally stable at 150° C. for much more than 100 years.

TABLE IV

Lifetime of an amorphous alloy according to embodiments of the present invention at 150° C.

| Alloy | Lifetime (years) |
|---|---|
| $Fe_{81.7}B_{16.0}Si_{2.0}C_{0.3}$ | 450 |

Figure 4:
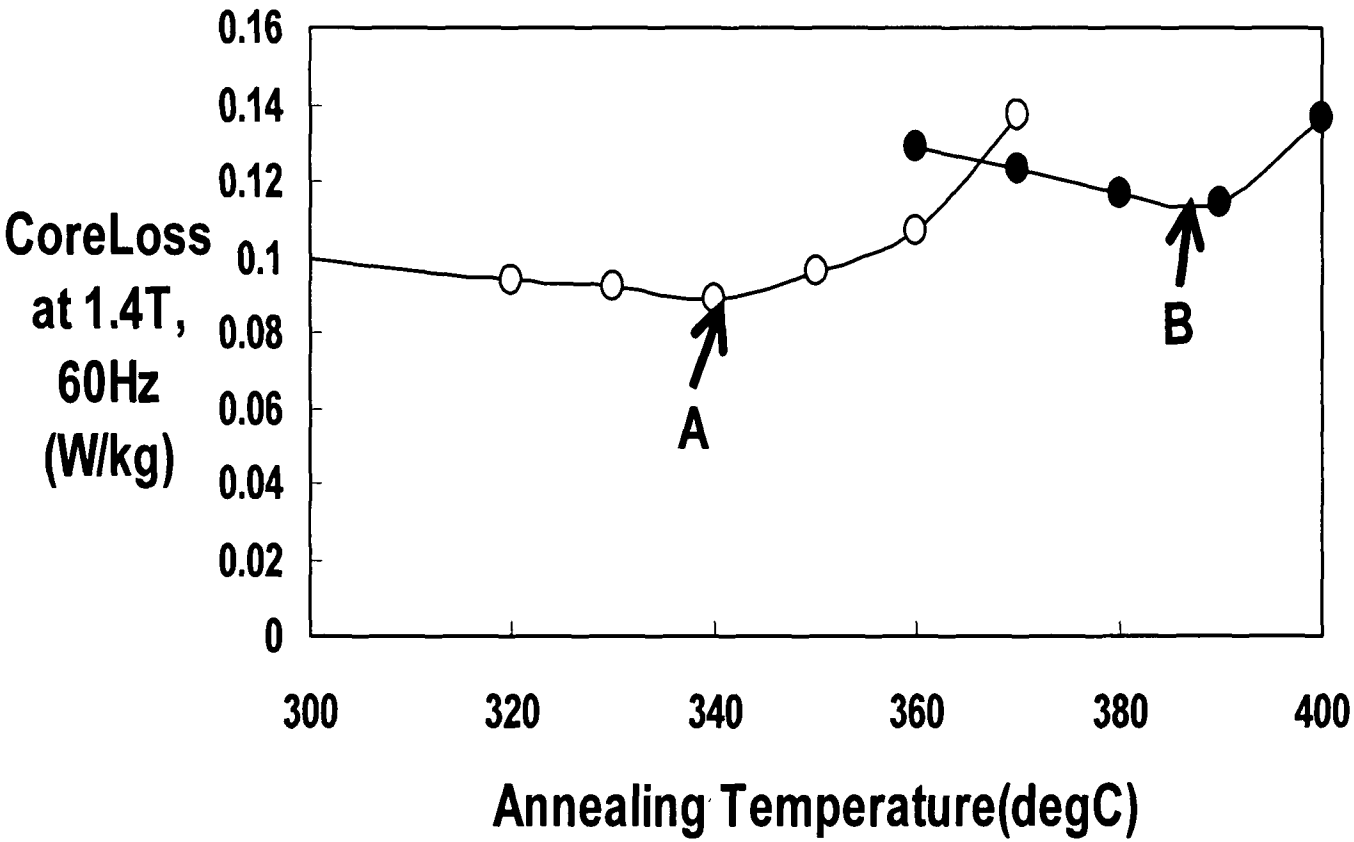
FIG. 4 shows the core loss measured at 60 Hz and 1.4 T induction for an amorphous alloy ribbon strip annealed for one hour between 300° C. and 370° C. with a DC magnetic field of 30 Oe (2400 A/m) having a composition of $Fe_{81.7}B_{16.0}Si_{2.0}C_{0.3}$, shown by curve A, of embodiments of the present invention and a ribbon strip of the commercially available METGLAS®2605SA1 alloy, shown by curve B, annealed at temperatures between 360° C. and 400° C. for one hour within a DC magnetic field of 30 Oe (2400 A/m).

In order to find optimal annealing conditions for the amorphous alloys according to embodiments of the present invention, annealing temperature and time were changed as described in Example II. FIG. 4 shows one such example of the results obtained for an amorphous alloy having a composition of $Fe_{81.7}B_{16.0}Si_{2.0}C_{0.3}$ of embodiments of the present invention, shown by curve "A", and the commercially available METGLAS2605SA1 alloy, shown by curve "B", when the annealing time is 1 hour, and the DC magnetic field applied along the strips' length direction is 2400 A/m. FIG. 4 clearly indicates that the core loss of the amorphous alloy of embodiments of the present invention is lower than that of the commercially available amorphous alloy when the former is annealed between 300° C. and 350° C.

The following examples are presented to provide a more complete understanding of the invention. The specific techniques, conditions, materials, proportions and reported data set forth to illustrate the principles and practice of the invention according to preferred embodiments are exemplary and should not be construed as limiting the scope of the invention.

Example I

About 60 kg of the constituent metals, such as FeB, FeSi, Fe and C, were melted in a crucible, and the molten metal was rapidly solidified by the method described in the U.S. Pat. No. 4,142,571. The ribbon formed had a width of about 170 mm and a thickness of about 25 μm and was tested by a conventional differential scanning calorimetry to assure its amorphous structure and determine the Curie temperature and the crystallization temperature of the ribbon material. A conventional Archimedes' method was used to determine the mass density, which was needed for material's magnetic characterization. The ribbon was found to be ductile.

Example II

The 170 mm wide ribbon was slit into 25 mm wide ribbon, which was used to wind toroidally shaped magnetic cores weighing about 60 gram each. The cores were heat-treated at 300-370° C. for one hour in a DC magnetic field of 30 Oe (2400 A/m), applied along the toroids' circumference direction for the alloys of embodiments of the present invention and at 360° C.-400° C. for two hours in a DC magnetic field of 30 Oe (2400 A/m) applied along the toroids' circumference direction for the commercially available METGLAS®2605SA1 alloy. A primary copper wire winding of 10 turns and a secondary winding of 10 turns were applied on the heat-treated cores for magnetic measurements. In addition, ribbon strips of a dimension of 230 mm in length and 85 mm in width were cut from amorphous alloys of embodiments of the present invention and from the commercially available METGLAS®2605SA1 alloy and were heat-treated at temperatures between 300° C. and 370° C. for the amorphous alloy of embodiments of the present invention and between 360° C. and 400° C. for the commercially available alloy, both with a DC magnetic field of about 30 Oe (2400 A/m) applied along the strips' length direction.

Example III

The magnetic characterizations of the heat-treated magnetic cores with primary and secondary copper windings of Example II were performed by using commercially available BH loop tracers with DC and AC excitation capability. AC magnetic characteristics, such as core loss, were examined by following ASTM A912/A912M-04 Standards for 50/60 Hz measurements. The magnetic properties such as AC core loss of the annealed straight strips of Example II with length of 230 mm and width of 85 mm were tested by following ASTM A 932/A932M-01 Standards.

Example IV

The well-characterized cores of Example III were used for accelerated aging tests at temperatures above 250° C. During the tests, the cores were in an exciting field at 60 Hz which induced a magnetic induction of about 1 T to simulate actual transformer operations at the elevated temperatures.

Although a few embodiments and examples of the present invention have been shown and described, it would be appreciated by those skilled in the art that changes may be made in these embodiments without departing from the principles and spirit of the invention, the scope of which is defined in the claims and their equivalents.

What is claimed:

1. A magnetic core having an iron-based amorphous alloy according to a chemical composition with a formula $Fe_aB_bSi_cC_d$ where $81.7 \le a \le 84$, $10 \le b \le 18$, $0 < c \le 5$ and $0.3 \le d \le 1$, numbers being in atomic percent with $a+b+c+d=100$, with incidental impurities, simultaneously having a value of saturation magnetic induction greater than or equal to 1.63 tesla, a Curie temperature of at least 300° C. and below 360° C., and a crystallization temperature of at least 400° C., wherein the alloy has been annealed at temperatures between 300° C. and 360° C. in a DC magnetic field of about 20-30 Oe applied along a toroid's circumference direction of the core or along a strips' length direction where a strip is used to prepare the core, and wherein a core loss is less than or equal to 0.5 W/kg when measured at 60 Hz, 1.5 tesla and at room temperature.

2. The magnetic core of claim 1, wherein the alloy is represented by a formula of $Fe_{81.7}B_{16.0}Si_{2.0}C_{0.3}$, $Fe_{82.0}B_{16.0}Si_{1.0}C_{1.0}$, $Fe_{82.0}B_{14.0}Si_{3.0}C_{1.0}$, $Fe_{82.0}B_{13.5}Si_{4.0}C_{0.5}$, $Fe_{82.0}B_{13.0}Si_{4.0}C_{1.0}$, $Fe_{82.6}B_{15.5}Si_{1.6}C_{0.3}$, $Fe_{83.0}B_{13.0}Si_{3.0}C_{1.0}$ or $Fe_{84.0}B_{13.0}Si_{2.0}C_{1.0}$.

3. The magnetic core of claim 1, wherein the saturation magnetic induction is greater than 1.65 tesla.

4. The magnetic core of claim 3, wherein the alloy is represented by a formula of $Fe_{81.7}B_{16.0}Si_{2.0}C_{0.3}$, $Fe_{82.0}B_{16.0}Si_{1.0}C_{1.0}$, $Fe_{82.0}B_{14.0}Si_{3.0}C_{1.0}$, $Fe_{82.0}B_{13.5}Si_{4.0}C_{0.5}$, or $Fe_{83.0}B_{13.0}Si_{3.0}C_{1.0}$.

5. A magnetic core comprising a heat-treated iron-based amorphous alloy according to a chemical composition with a formula $Fe_aB_bSi_cC_d$ where $81.7 \le a \le 84$, $10 \le b \le 18$, $0 < c \le 5$ and $0.3 \le d \le 1$, numbers being in atomic percent with $a+b+c+d=100$, with incidental impurities, simultaneously having a value of saturation magnetic induction greater than or equal to 1.63 tesla, a Curie temperature of at least 300° C. and below 360° C., and a crystallization temperature of at least 400° C., wherein the alloy has been annealed at temperatures between 300° C. and 360° C. in a DC magnetic field of about 20-30 Oe applied along a toroid's circumference direction of the core or along a strips' length direction where a strip is used to prepare the core, wherein a core loss is less than or equal to 0.5 W/kg when measured at 60 Hz, 1.5 tesla and at room temperature, wherein the magnetic core is a magnetic core of a transformer or a electrical choke coil, and wherein a DC BH squareness ratio of the alloy is greater than 0.8.

6. A magnetic core comprising a heat-treated iron-based amorphous alloy according to a chemical composition with a formula $Fe_aB_bSi_cC_d$ where $81.7 \le a \le 84$, $10 \le b \le 18$, $0 < c \le 5$ and $0.3 \le d \le 1$, numbers being in atomic percent with $a+b+c+d=100$, with incidental impurities, simultaneously having a value of saturation magnetic induction greater than or equal to 1.63 tesla, a Curie temperature of at least 300° C. and below 360° C., and a crystallization temperature of at least 400° C., wherein the alloy has been annealed at temperatures between 300° C. and 360° C. in a DC magnetic field of about 20-30 Oe applied along a toroid's circumference direction of the core or along a strips' length direction where a strip is used to prepare the core, wherein a DC squareness ratio is greater than 0.8, wherein a core loss measured at 60 Hz and at 1.5 tesla is less than or equal to 0.5 W/kg, and wherein the magnetic core is an inductor core of a magnetic switch in a pulse generator and/or compressor.

7. An iron-based amorphous alloy according to a chemical composition with a formula $Fe_aB_bSi_cC_d$ where $81.7 < a \le 84$, $10 \le b \le 18$, $0 < c \le 5$ and $0 < d < 1.5$, numbers being in atomic percent with $a+b+c+d=100$, with incidental impurities, simultaneously having a value of saturation magnetic induction greater than or equal to 1.63 tesla, a Curie temperature of at least 300° C. and a crystallization temperature of at least 400° C., wherein the alloy has been annealed in a DC magnetic field of about 20-30 Oe applied along a toroid's circumference direction of the core or along a strip's length direction where a strip is used to prepare the core.

8. The alloy of claim 7, wherein the alloy is represented by a formula of $Fe_{81.7}B_{16.0}Si_{2.0}C_{0.3}$, $Fe_{82.0}B_{16.0}Si_{1.0}C_{1.0}$, $Fe_{82.0}B_{14.0}Si_{3.0}C_{1.0}$, $Fe_{82.0}B_{13.5}Si_{4.0}C_{0.5}$, $Fe_{82.0}B_{13.0}Si_{4.0}C_{1.0}$, $Fe_{82.6}B_{15.5}Si_{1.6}C_{0.3}$, $Fe_{83.0}B_{13.0}Si_{3.0}C_{1.0}$ or $Fe_{84.0}B_{13.0}Si_{2.0}C_{1.0}$.

9. The alloy of claim 7, wherein the saturation magnetic induction is greater than 1.65 tesla.

10. The alloy of claim 9, wherein the alloy is represented by a formula of $Fe_{81.7}B_{16.0}Si_{2.0}C_{0.3}$, $Fe_{82.0}B_{16.0}Si_{1.0}C_{1.0}$, $Fe_{82.0}B_{14.0}Si_{3.0}C_{1.0}$, $Fe_{82.0}B_{13.5}Si_{4.0}C_{0.5}$, or $Fe_{83.0}B_{13.0}Si_{3.0}C_{1.0}$.

11. The alloy of claim 7, wherein the alloy is heat-treated by annealing at temperatures between 300° C. and 350° C.

12. The alloy of claim 11, wherein the alloy is utilized in a magnetic core and a core loss is less than or equal to 0.5 W/kg when measured at 60 Hz, 1.5 tesla and at room temperature.

13. The magnetic core of claim 5, wherein the alloy is represented by a formula of $Fe_{81.7}B_{16.0}Si_{2.0}C_{0.3}$, $Fe_{82.0}B_{16.0}Si_{1.0}C_{1.0}$, $Fe_{82.0}B_{14.0}Si_{3.0}C_{1.0}$, $Fe_{82.0}B_{13.5}Si_{4.0}C_{0.5}$, $Fe_{82.0}B_{13.0}Si_{4.0}C_{1.0}$, $Fe_{82.6}B_{15.5}Si_{1.6}C_{0.3}$, $Fe_{83.0}B_{13.0}Si_{3.0}C_{1.0}$ or $Fe_{84.0}B_{13.0}Si_{2.0}C_{1.0}$.

14. The magnetic core of claim 6, wherein the alloy is represented by a formula of $Fe_{81.7}B_{16.0}Si_{2.0}C_{0.3}$, $Fe_{82.0}B_{16.0}Si_{1.0}C_{1.0}$, $Fe_{82.0}B_{14.0}Si_{3.0}C_{1.0}$, $Fe_{82.0}B_{13.5}Si_{4.0}C_{0.5}$, $Fe_{82.0}B_{13.0}Si_{4.0}C_{1.0}$, $Fe_{82.6}B_{15.5}Si_{1.6}C_{0.3}$, $Fe_{83.0}B_{13.0}Si_{3.0}C_{1.0}$ or $Fe_{84.0}B_{13.0}Si_{2.0}C_{1.0}$.

15. The magnetic core of claim 1, wherein $13 \le b \le 18$.

16. The magnetic core of claim 5, wherein $13 \le b \le 18$.

17. The magnetic core of claim 6, wherein $13 \le b \le 18$.

18. The alloy of claim 7, wherein $13 \le b \le 18$.

19. The alloy of claim 12, wherein $13 \le b \le 18$.

* * * * *